US011324295B2

(12) United States Patent
Paik et al.

(10) Patent No.: US 11,324,295 B2
(45) Date of Patent: May 10, 2022

(54) BUCKLE

(71) Applicant: WOOJIN PLASTIC Co., Ltd., Namyangju-si (KR)

(72) Inventors: Ji Sook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD., Namyangju-si (KR)

( * ) Notice: Subject to any disclaimer, the term of this patent is extended or adjusted under 35 U.S.C. 154(b) by 156 days.

(21) Appl. No.: 16/874,027

(22) Filed: May 14, 2020

(65) Prior Publication Data

US 2020/0359761 A1 Nov. 19, 2020

(30) Foreign Application Priority Data

May 14, 2019 (KR) ..... 10-2019-0055979

(51) Int. Cl.
*A45C 13/10* (2006.01)
*A44B 11/00* (2006.01)
*A44B 11/26* (2006.01)

(52) U.S. Cl.
CPC ..... *A45C 13/1069* (2013.01); *A44B 11/005* (2013.01); *A44B 11/26* (2013.01)

(58) Field of Classification Search
CPC ... A45C 13/1069; A45C 13/10; A44B 11/005; A44B 11/26; A44B 11/258; A44B 11/25; A44B 11/2588; A44D 2203/00
See application file for complete search history.

(56) References Cited

U.S. PATENT DOCUMENTS

| | | | | |
|---|---|---|---|---|
| 2,648,884 | A * | 8/1953 | Loofboro | A44C 5/2071 24/303 |
| 6,857,169 | B2 * | 2/2005 | Chung | A44B 11/258 24/303 |
| 7,496,994 | B1 * | 3/2009 | Headley | A44C 5/2019 24/303 |
| 8,914,951 | B2 * | 12/2014 | Gaudillere | A44B 11/266 24/303 |
| 9,936,772 | B2 * | 4/2018 | Paik | A45F 3/047 |
| 10,085,521 | B2 * | 10/2018 | Chen | A45C 13/1069 |
| 10,143,270 | B2 * | 12/2018 | Fiedler | A44B 11/2588 |
| 10,874,178 | B2 * | 12/2020 | Cheng | A44B 11/2511 |
| 11,089,844 | B2 * | 8/2021 | Vaccari | A44B 11/2592 |

FOREIGN PATENT DOCUMENTS

| | | |
|---|---|---|
| DE | 20 2010 010 300 U1 | 11/2010 |
| EP | 3 183 986 A1 | 6/2017 |
| KR | 10-0501498 B1 | 7/2005 |
| KR | 10-0756277 B1 | 9/2007 |
| KR | 10-2008-0113432 A | 12/2008 |
| KR | 10-1132100 B1 | 4/2012 |
| KR | 10-1811501 B1 | 12/2017 |
| WO | WO 2014/090926 A1 | 6/2014 |

* cited by examiner

*Primary Examiner* — Robert Sandy
*Assistant Examiner* — Rowland Do
(74) *Attorney, Agent, or Firm* — Paratus Law Group, PLLC

(57) ABSTRACT

A buckle including: a male buckle member; a female buckle member; locking and unlocking means locked and unlocked by a relative sliding action of the male buckle member and the female buckle member; and a releasing means for unlocking the locking and unlocking means by sliding the male buckle member and the female buckle member in a release direction.

9 Claims, 13 Drawing Sheets

*-Prior Art-*

*-Prior Art-*

*-Prior Art-*

*-Prior Art-*

BUCKLE

CROSS-REFERENCE TO PRIOR APPLICATION

This application claims priority to Korean Patent Application No. 10-2019-0055979 (filed on May 14, 2019), which is hereby incorporated by reference in its entirety.

BACKGROUND

The present invention relates to a buckle, and more particularly, to a buckle which is not easily released under an unintended situation, can firmly keep fastening force of the buckle, can be easily released just with one hand or one finger when a user releases the buckle, and can be locked and unlocked easily and rapidly in time of emergency.

In general, a buckle is a fastening means which includes a pair of male and female members respectively mounted at end portions of belts or straps of a backpack for climbers or a bag in order to connect the belts or straps with each other. Such a buckle is made of a plastic material and is formed integrally so that the male member and the female member are combined with each other elastically.

FIG. 1 is an exploded perspective view of a conventional open type buckle, and FIG. 2 is an exploded perspective view of a conventional closed type buckle.

The open type buckle 10 as shown in FIG. 1 has slots 34 formed in a female member 30. Both fastening legs 22 of a male member 20 are inserted into a chamber 32 of the female member 30, and are locked to the slots 34 opened at both sides of the female member 30. In order to unlock the buckle 10, when a user presses the fastening legs 22 locked to the slots 34, the male and female members 20 and 30 are released from each other. The closed type buckle 40 as shown in FIG. 2 does not have slots formed in a female member 60. A male member 50 has a fastening part formed at a front end portion thereof, and the fastening part is inserted into a body of the female member 60 to be combined with a locking part formed in the female member 60. After that, in order to unlock the buckle, the user presses a pressing part 63 formed on an external part of the female member 60.

That is, the open type buckle 10 is released when the user presses the fastening legs 22 of the male member 20 locked into the open slots 34 of the female member 30, but the closed type buckle 40 is released when the user presses a portion of the external part of the female member 60 since the female member 60 does not have slots and is not opened.

So, users may select any one among the open type buckle and the closed type buckle depending on use purposes or according to the need with respect to backpacks for climbers, bags, clothes, and other articles.

Referring to FIGS. 2, 3A and 3B, the conventional closed type buckle will be described in more detail. FIG. 3A is a sectional view taken along the line A-A' of FIG. 2, and FIG. 3B is a sectional view taken along the line B-B' of FIG. 2.

The closed type buckle 40 includes a female member 60 and a male member 50.

As shown in the drawings, the female member 60 includes a chamber 61 opened from the front end portion, and an upper plate 62 formed at the upper side and having the pressing part 63 of which three sides are separated from the upper plate 62 and of which the rest one side is integrated with the upper plate 62 and has a groove 64. Guide surfaces 65 for fastening legs 51 are formed below the pressing part 63 to be spaced apart from each other at a predetermined interval. The female member 60 has retaining jaws 66 formed at the front end portions of the guide surfaces 65 so as to be coupled with retaining parts 53 of the male member 50.

The male member 250 has the fastening legs 51 protruding straight from both sides of a body of the male member 50. Each of the fastening legs 51 has a "¬"-shaped portion 52 inwardly formed at the front end portion thereof and the retaining part 53 formed at the lower end of the "¬"-shaped portion 52, and the retaining part 53 engages with the retaining jaw 66 of the female member 60. An elastically releasing piece 54 is formed in the middle of the male member 50 and between the fastening legs 51 and is located above the guide surfaces 65 when the buckle is locked.

As described above, in case that the conventional open type buckle 40 is locked, when the fastening legs 51 formed at both sides of the male member 50 are inserted into the chamber 61 of the front end of the female member 60, the retaining part 53 formed at the lower end portions of the front sides of the fastening legs 51 are inserted while sliding along the guide surfaces 65 of the female member 60, and are elastically coupled with the retaining jaws 66 formed at the front end portions of the guide surfaces 65 of the female member 60 so that the male member 50 and the female member 60 are coupled with each other.

After that, in order to release the buckle 40, when the user presses the pressing part 63 formed at the upper end of the female member 60, the elastically releasing piece 54 of the male member 50 separates the retaining jaws 66 of the female member 60 and the retaining parts 53 of the male member 50, which are coupled with each other, from each other, so that the members are separated from each other.

However, the conventional closed type buckle 40 is difficult to be locked since configured such that the fastening means formed at each member, namely, the retaining jaws 66 of the female member 60 and the retaining parts 53 of the male member 50 are coupled with each other deep in the female member 60 in order to fasten the fastening legs 51 into the chamber 61 of the female member 60. Additionally, there is a danger of an accident since the conventional closed type buckle 40 can be easily released due to its weak fastening force. In addition, because the three sides of the pressing parts 63 are separated from the upper plate 62 of the female member 60 and the fastening legs 51 and the elastically releasing piece 54 of the male member 50 are also separated from one another, the entire strength of the buckle is very weak, whereby the buckle 40 may be easily damaged when used for a long time.

Moreover, as described above, the closed type buckle 40 is configured such that the user presses the pressing part 63 of the female member 60 to second press the elastically releasing piece 54 of the male member 50 located at the lower end portion below the pressing part so as to release the members. Therefore, the closed type buckle 40 has several disadvantages in that it is difficult to lock and unlock the buckle due to its complicated structure and the manufacturing cost is increased.

In the meantime, in order to solve the problems of the conventional buckles, Korean Patent No. 10-1811501 discloses a buckle capable of being easily locked and unlocked when a user presses its middle part with one hand. However, the buckle also has disadvantages in that it may cause an accident since being easily released when an external shock is applied or the buckle is bumped under an unintended situation, and in that the buckle cannot easily cope with urgent situations.

PATENT LITERATURE

Patent Documents

Patent Document 1: Korean Patent No. 10-0501498 (published on Jul. 25, 2005)

Patent Document 2: Korean Patent No. 10-1132100 (published on Apr. 4, 2012)

Patent Document 3: Korean Patent No. 10-1811501 (published on Dec. 20, 2017)

SUMMARY

Accordingly, the present invention has been made to solve the above-mentioned problems occurring in the prior arts, and it is an object of the present invention to provide a buckle which is not easily released under an unintended situation, can firmly keep fastening force of the buckle, can be easily released just with one hand or one finger when a user releases the buckle, and can be locked and unlocked easily and rapidly in time of emergency.

Technical objects to be achieved by the present invention are not limited to the above-described objects and other technical objects that have not been described will be evidently understood by those skilled in the art from the following description.

To accomplish the above object, according to the present invention, there is provided a buckle, which includes a male buckle member and a female buckle member coupled with each other to be locked and unlocked, including: a male buckle member having a first magnet buried or received in the middle part thereof; a female buckle member coupled with and uncoupled from the male buckle member in a sliding manner and having a second magnet buried or received in the middle part thereof; locking and unlocking means respectively disposed at the male buckle member and the female buckle member to be locked or unlocked by a relative sliding action of the male buckle member and the female buckle member; and releasing means respectively disposed at the male buckle member and the female buckle member to slide the male buckle member and the female buckle member in a release direction so that the locking and unlocking means are unlocked.

The male buckle member includes: a male buckle plate type part having a first magnet mounting part in which the first magnet is buried or received to be fixed; and a strap connection part formed at an end portion of the male buckle plate type part so that a belt or a strap is connected, the female buckle member includes: a female buckle plate type part having a through hole part formed in one side and a second magnet mounting part formed at the other side so that the second magnet is buried or received to be fixed therein; and side wall parts protruding from both sides of the female buckle plate type part, and the locking and unlocking means respectively include: locking and unlocking coupling parts protruding from both sides of the bottom surface of the male buckle plate type part; and locking and unlocking coupled parts formed at both sides of the bottom surface of the female buckle plate type part so that the locking and unlocking coupling parts and the locking and unlocking coupled parts are coupled with each other to be locked and unlocked depending on a relative back-and-forth sliding action thereof.

The locking and unlocking coupling parts are protrusions formed at both sides of the male buckle plate type part, and the protrusions are formed in a right-angled triangle of which the inclined plane faces the outside when being viewed from the rear side and have locking protrusions formed at the bottom ends thereof, and the locking and unlocking coupled parts include: through holes formed at both sides of the female buckle plate type part; and retaining plates horizontally protruding from the inside of the through holes, having upper end edges formed to correspond to the inclined surfaces of the locking protrusions of the locking and unlocking coupling parts, and being inserted into the locking and unlocking coupling parts.

The releasing means includes: a pair of hinge coupling pieces extending from both sides of the other end portion of the male buckle plate type part; a releasing rotation plate of which one end portion is hinge-coupled to the hinge coupling piece to be rotatably coupled to the male buckle member; a gripping member detachably joined to the other end portion of the releasing rotation plate; an elastic member formed on the male buckle plate type part between the hinge coupling pieces to elastically support the releasing rotation plate in a counterrotation direction; and release linking means respectively formed on the female buckle member and the releasing rotation plate so that the locking and unlocking coupling parts are released from the locking and unlocking coupled parts by relatively moving the male buckle member and the female buckle member in the release direction due to the rotation of the releasing rotation plate.

The releasing rotation plate includes: a manipulation plate part; a pair of plate type protrusions formed at both sides of the bottom surface of the manipulation plate part; and hinge shafts formed on the outer surfaces of the plate type protrusions to be hinge-coupled to the hinge coupling pieces.

The release linking means includes: a sliding cam groove formed on one side of a lower end portion of the plate type protrusion of the releasing rotation plate; and a sliding cam protrusion formed at the female buckle member to correspond to the shape of the sliding cam groove.

The sliding cam groove is formed in a rectangular shape that the lower end of the plate type protrusion becomes the base line, and the side facing the direction that the male buckle member and the female buckle member are coupled with each other is a downwardly inclined surface, and the sliding cam protrusion has a shape corresponding to the sliding cam groove.

The gripping member is a strap connected to a connection hole formed in the releasing rotation plate, or a strap having a gripper disposed at an end portion thereof.

The gripping member is a strap connected to a connection hole formed in the releasing rotation plate and has a ring disposed at an end portion thereof.

An article according to another embodiment of the present invention includes the buckle according to the embodiment of the present invention.

Therefore, the buckle according to an embodiment of the present invention is not easily released under an unintended situation, can firmly keep fastening force of the buckle.

Moreover, the buckle according to an embodiment of the present invention can be easily released just with one hand or one finger when a user releases the buckle, and can be locked and unlocked easily and rapidly in time of emergency, thereby promoting usability and safety.

The effects of the present invention are not limited to the above-described objects and other technical objects that have not been described will be evidently understood by those skilled in the art from the following description.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Figure 1:
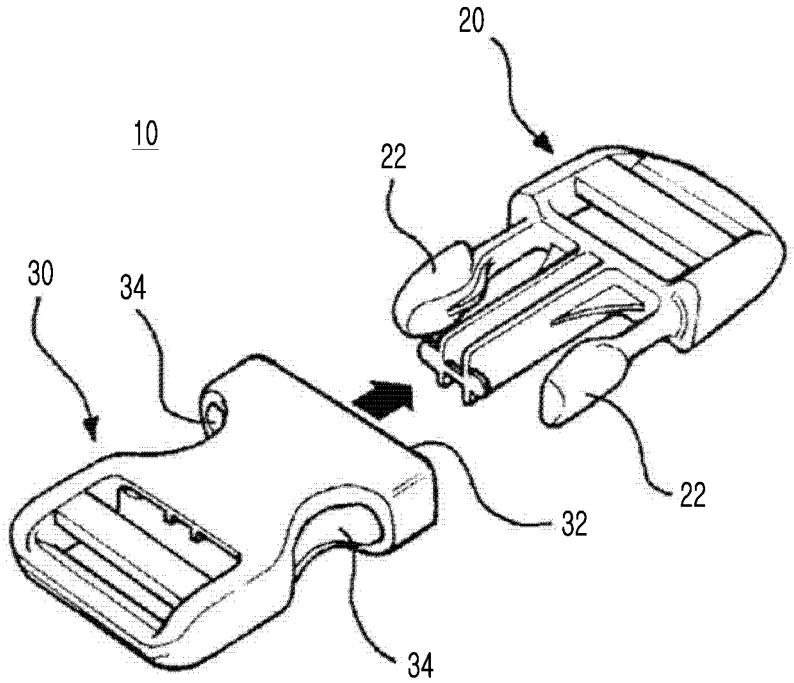
FIG. 1 is an exploded perspective view of a conventional open type buckle.
Figure 2:
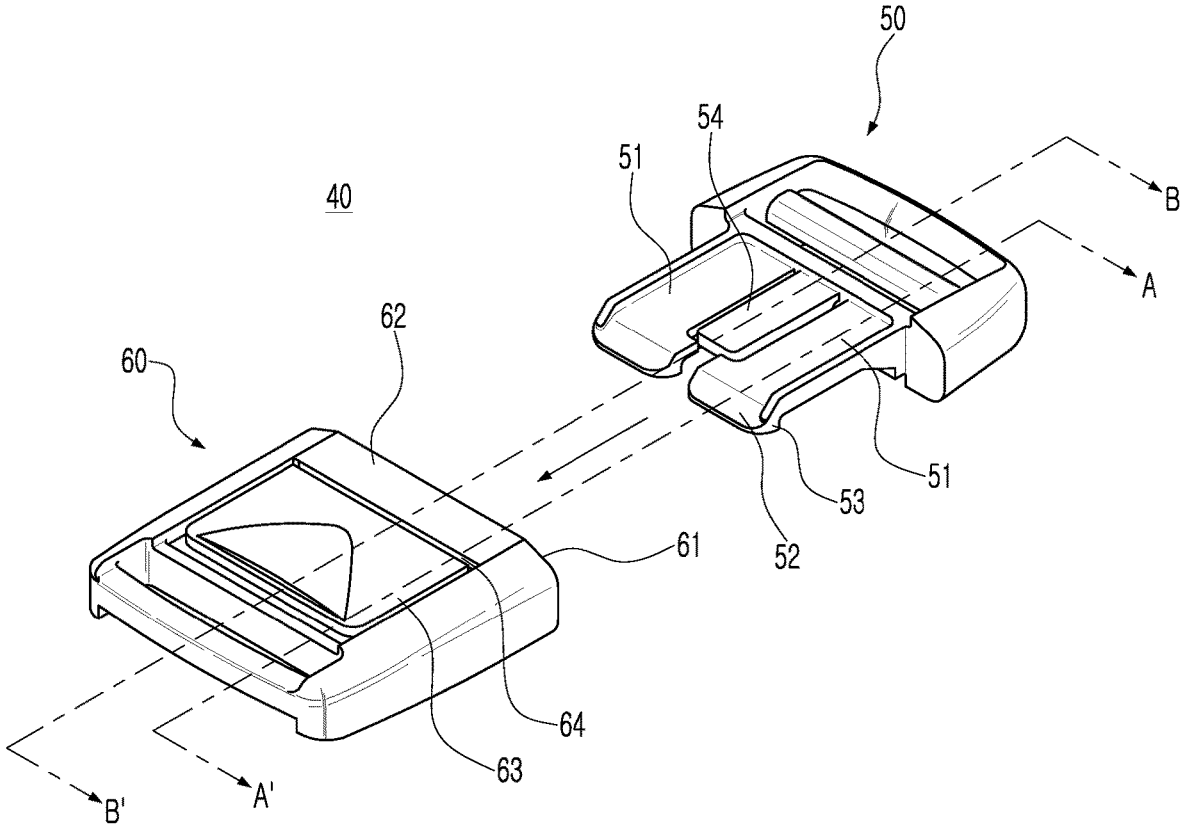
FIG. 2 is an exploded perspective view of a conventional closed type buckle.
Figure 3A:
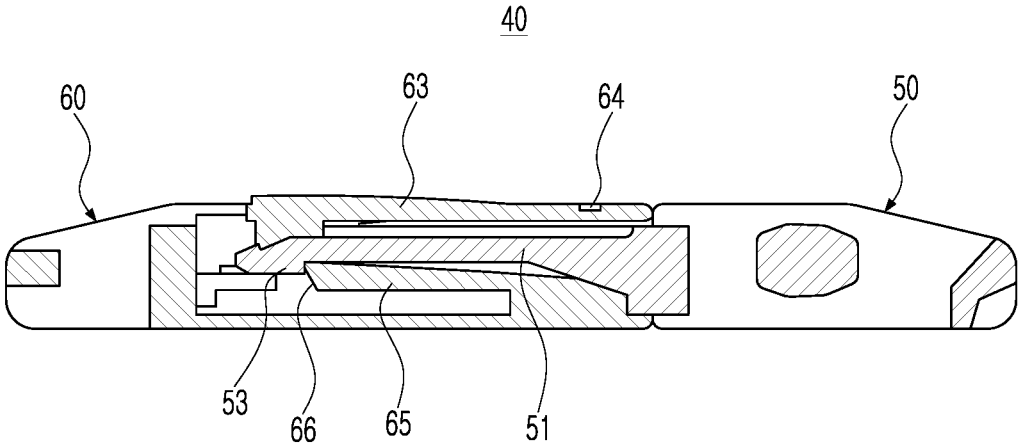
FIG. 3A is a sectional view taken along the line A-A' of FIG. 2, showing a combined state of the conventional buckle.
Figure 3B:
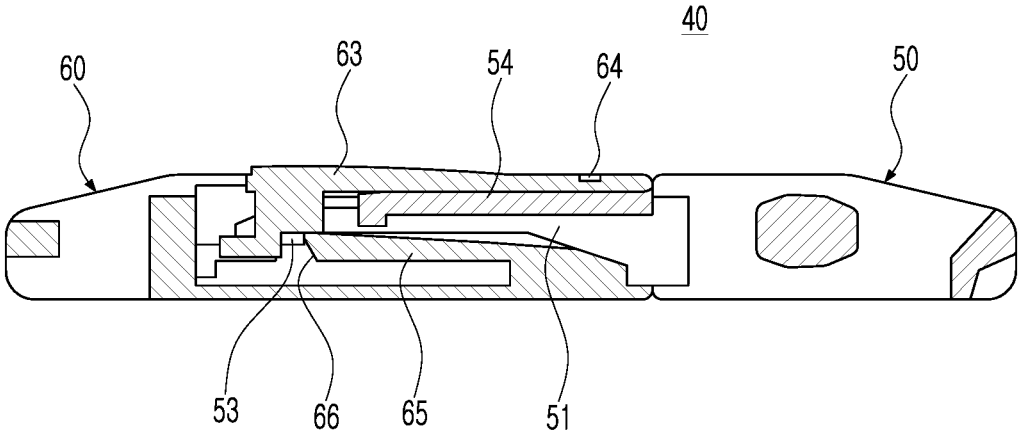
FIG. 3B is a sectional view taken along the line B-B' of FIG. 2, showing the combined state of the conventional buckle.

The above and other objects, features and other advantages of the present invention will be more clearly understood from the following detailed description with reference to the accompanying drawings.

The example embodiments of the present invention are capable of various modifications and alternative forms, and particular embodiments of the present invention will be illustrated in the attached drawings and described in this specification in detail. It should be understood, however, that there is no intent to limit example embodiments of the invention to the particular forms disclosed, but on the contrary, example embodiments of the invention are to cover all modifications, equivalents, and alternatives falling within the technical idea and scope of the present invention.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be further understood that the words or terms used in the present invention are used to describe specific embodiments of the present invention and there is no intent to limit the present invention. The singular form of the components may be understood into the plural form unless otherwise specifically stated in the context. It should be also understood that the terms of 'include' or 'have' in the specification are used to mean that there are characteristics, numbers, steps, operations, components, parts, or combinations of the steps, operations, components and parts described in the specification and there is no intent to exclude existence or possibility of other characteristics, numbers, steps, operations, components, parts, or combinations of the steps, operations, components and parts.

Moreover, in the following description, terms such as "part", "unit" and "module" indicate a unit for processing at least one function or operation, wherein the unit and the block may be embodied as hardware or software or embodied by combining hardware and software.

Furthermore, in describing the invention with reference to the accompanying drawings, like elements are referenced by like reference numerals or signs regardless of the drawing numbers and description thereof is not repeated.

In the description, details of well-known features and techniques may be omitted to avoid unnecessarily obscuring the presented embodiments.

Hereinafter, a buckle showing a firm fastening function and an easy release function according to a preferred embodiment of the present invention will be described in detail with reference to the drawings.

Figure 4:
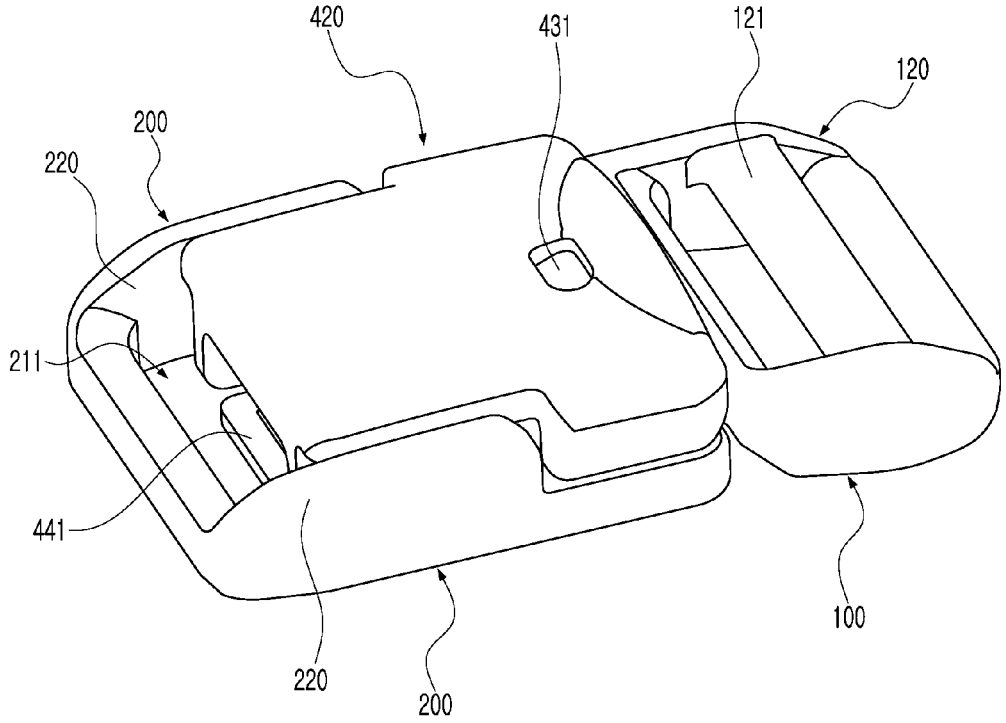
FIG. 4 is a perspective view of a buckle according to an embodiment of the present invention viewed from the top.
Figure 5:
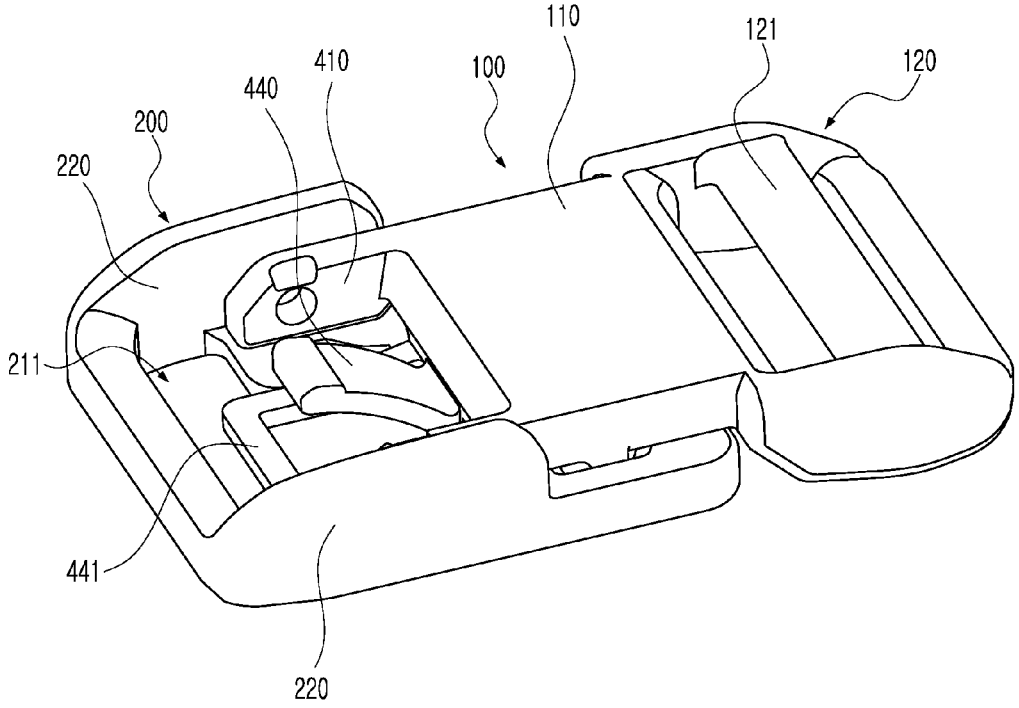
FIG. 5 is a view showing the buckle of FIG. 4 from which a releasing rotation plate is excluded.
Figure 6:
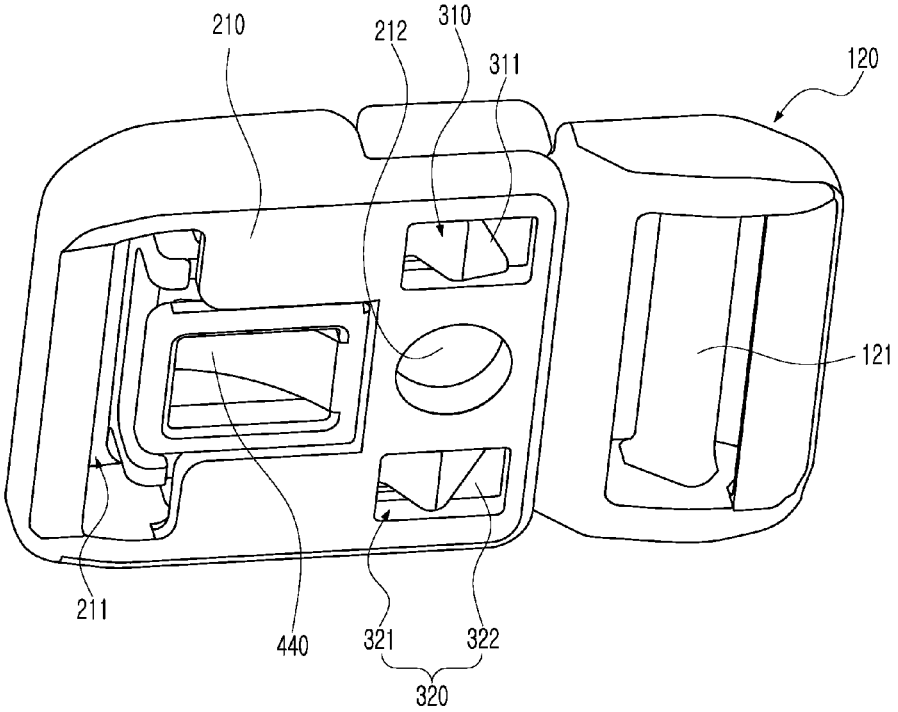
FIG. 6 is a perspective view of the buckle according to the embodiment of the present invention viewed from the bottom.
Figure 7:
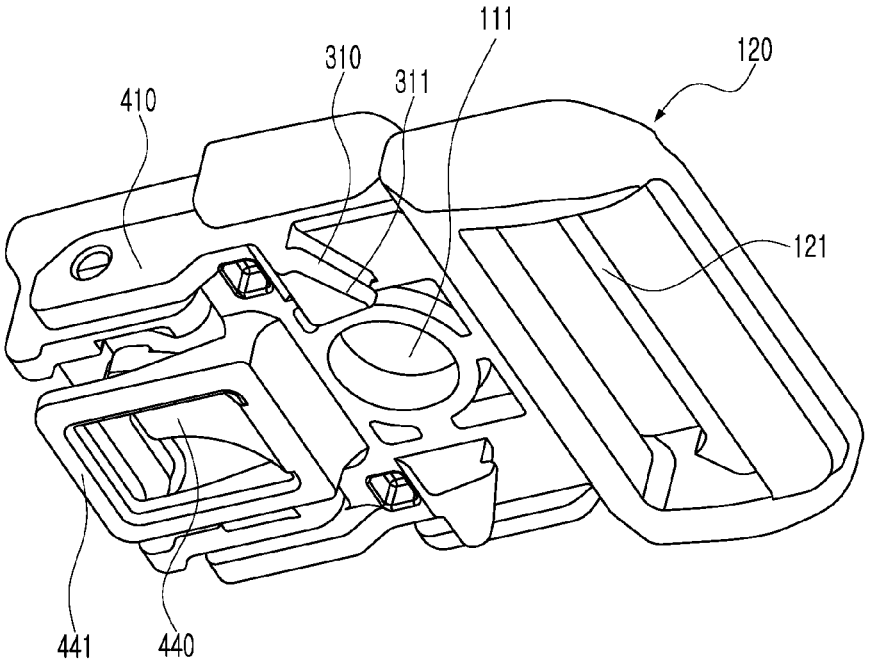
FIG. 7 is a perspective view of the buckle according to the embodiment of the present invention viewed from the bottom, from which a female buckle member is excluded.
Figure 8:
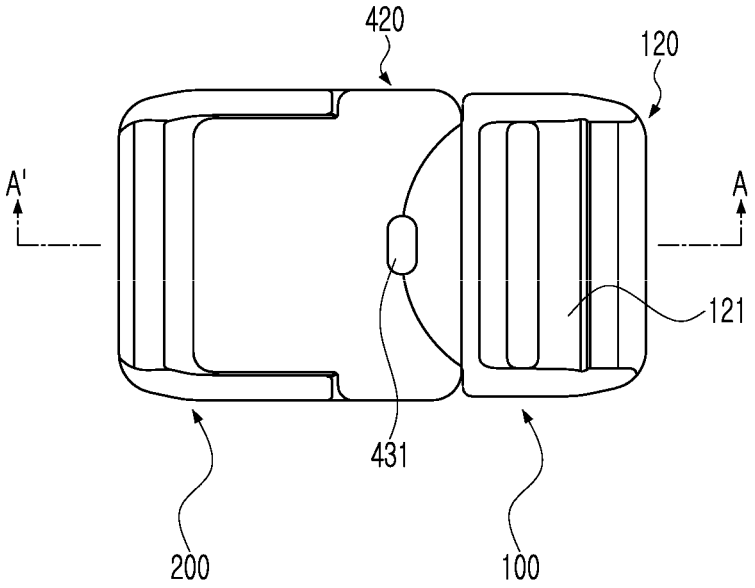
FIG. 8 is a plan view showing the buckle according to the embodiment of the present invention.
Figure 9:
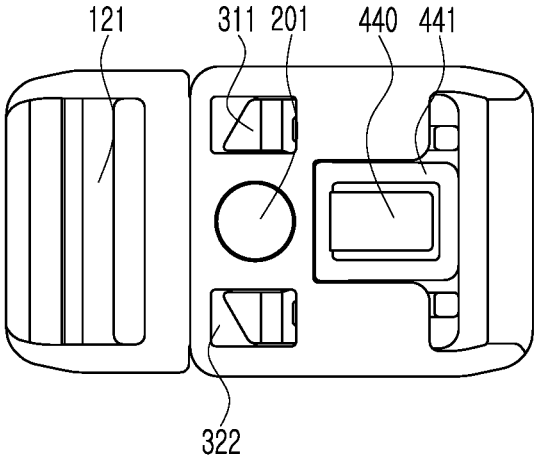
FIG. 9 is a bottom side view showing the buckle according to the embodiment of the present invention.
Figure 10:
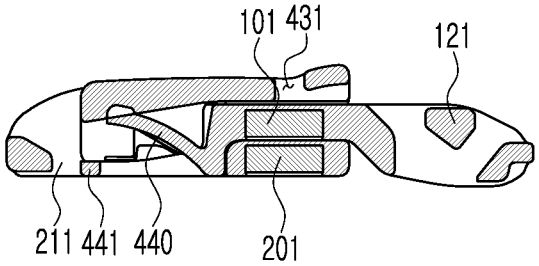
FIG. 10 is a sectional view taken along the line of A-A' of FIG. 8.
Figure 11:
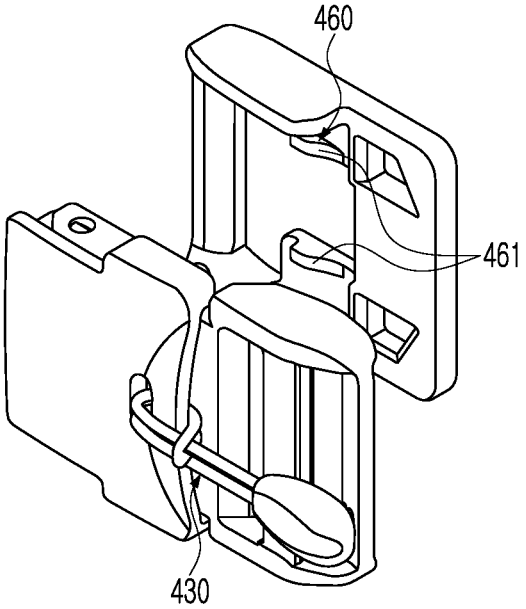
FIG. 11 is a perspective view showing a state before the releasing rotation plate is rotated under the condition that the buckle according to the embodiment of the present invention is released.
Figure 12:
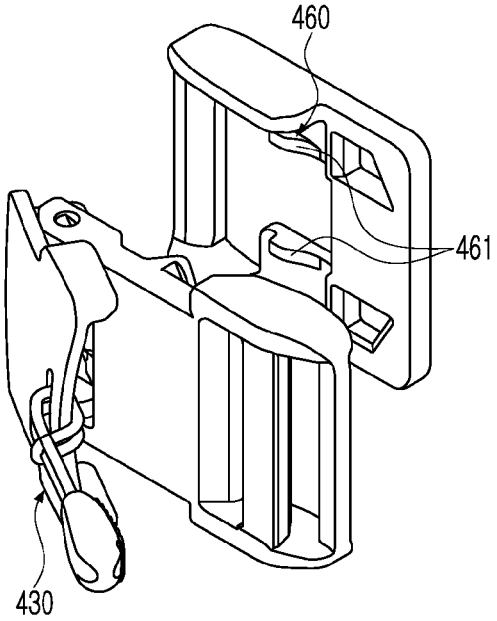
FIG. 12 is a perspective view showing a state where the releasing rotation plate is rotated under the condition that the buckle according to the embodiment of the present invention is released.
Figure 13:
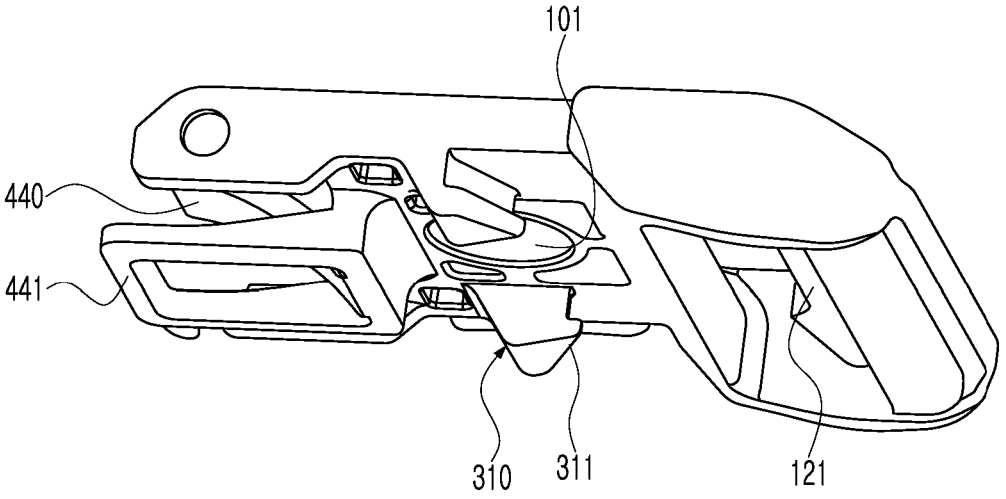
FIG. 13 is a perspective view of a portion of a male buckle member of the buckle according to the embodiment of the present invention viewed from the bottom.
Figure 14:
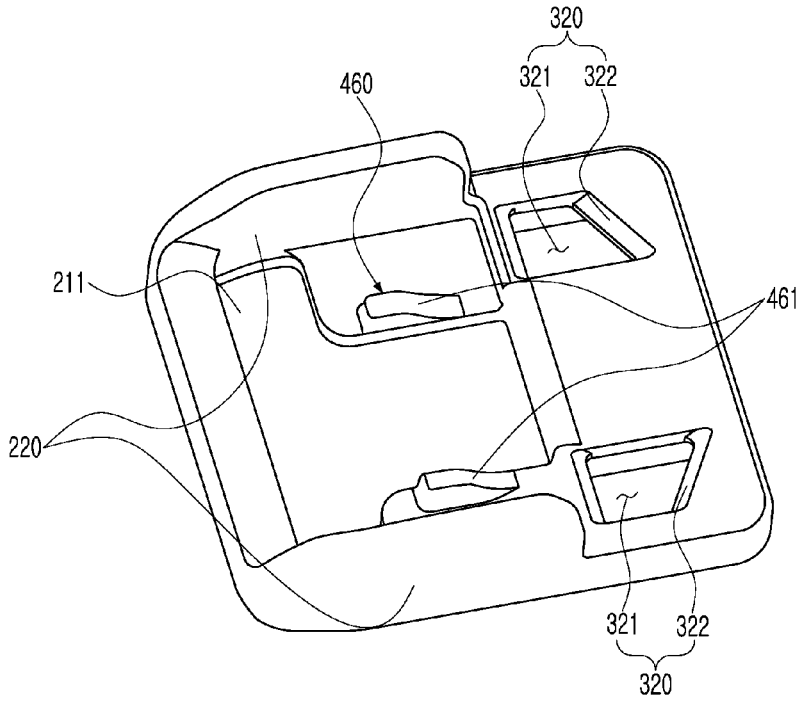
FIG. 14 is a perspective view of the female buckle member of the buckle according to the embodiment of the present invention viewed from the top.
Figure 15:
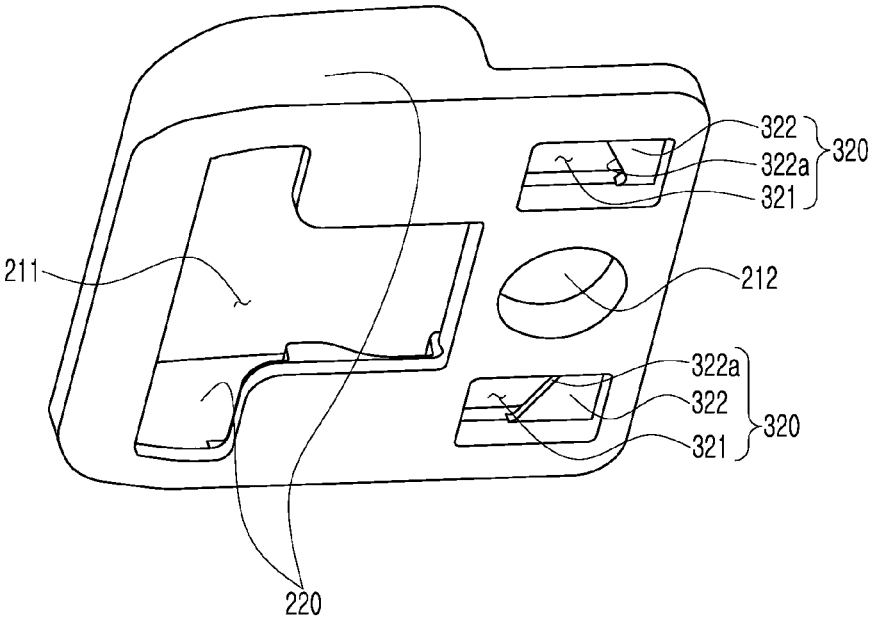
FIG. 15 is a perspective view of the female buckle member of the buckle according to the embodiment of the present invention viewed from the bottom.
Figure 16:
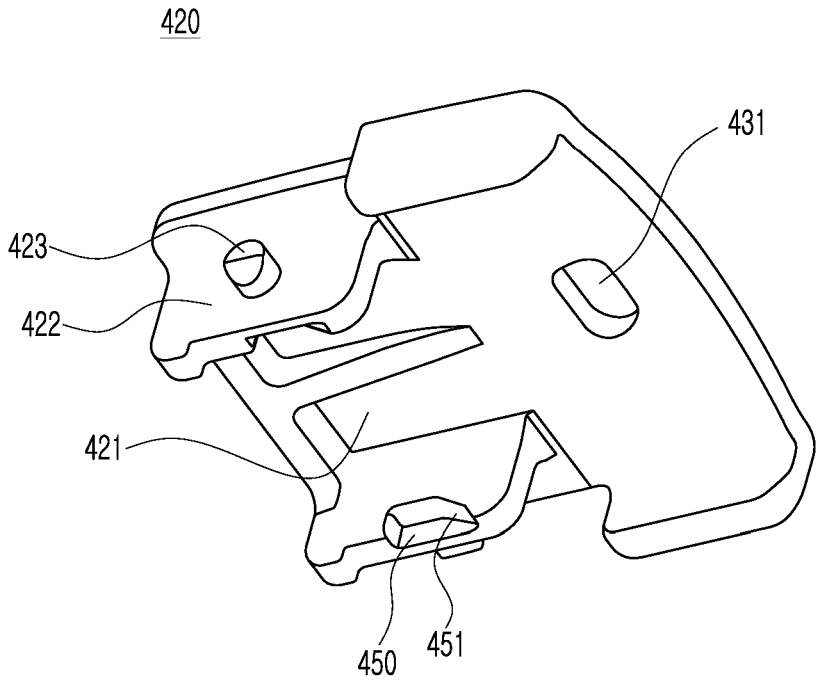
FIG. 16 is a perspective view of the releasing rotation plate of the buckle according to the embodiment of the present invention viewed from the bottom.
Figure 17:
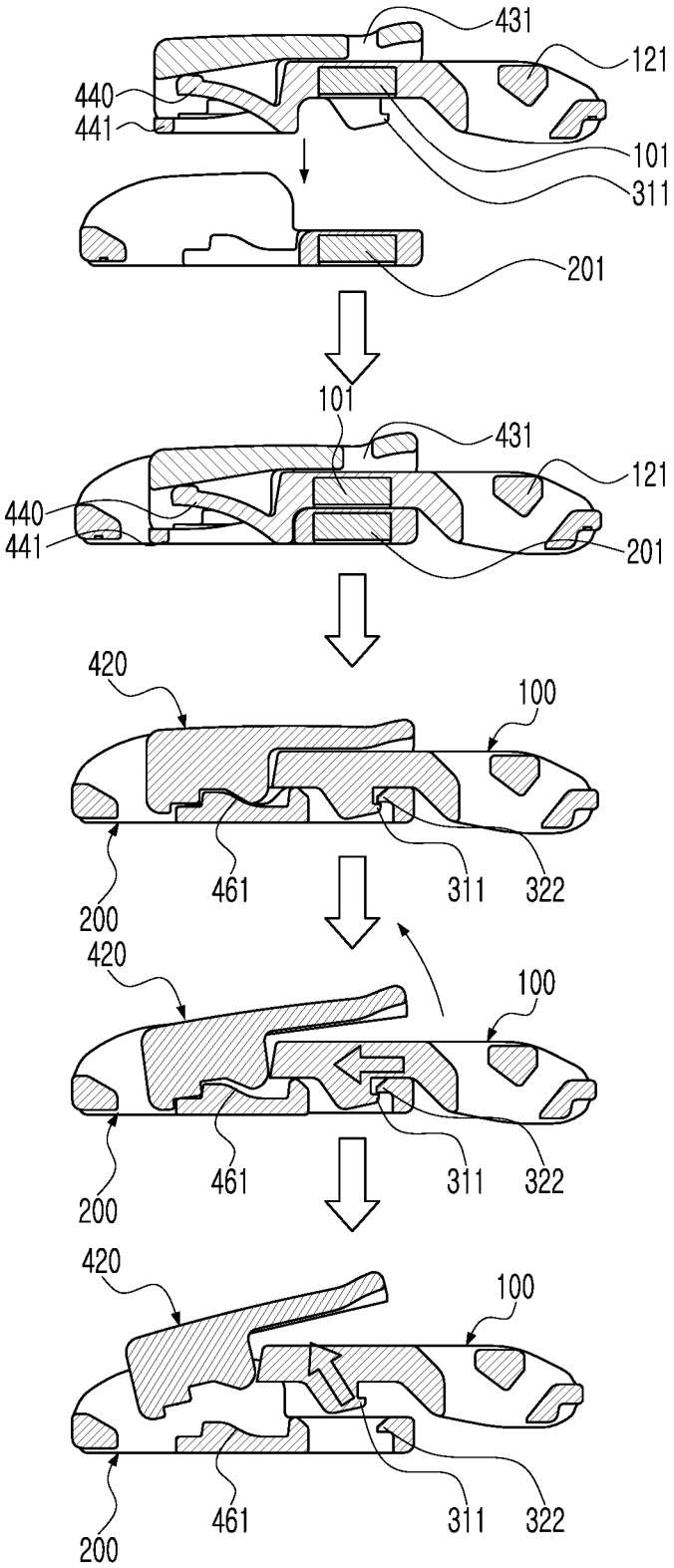
FIG. 17 is a sectional view showing a releasing process of the buckle according to the embodiment of the present invention.

FIG. 4 is a perspective view of a buckle according to an embodiment of the present invention viewed from the top, FIG. 5 is a view showing the buckle of FIG. 4 from which a releasing rotation plate is excluded, FIG. 6 is a perspective view of the buckle according to the embodiment of the present invention viewed from the bottom, FIG. 7 is a perspective view of the buckle according to the embodiment of the present invention viewed from the bottom, from which a female buckle member is excluded, FIG. 8 is a plan view showing the buckle according to the embodiment of the present invention, FIG. 9 is a bottom side view showing the buckle according to the embodiment of the present invention, FIG. 10 is a sectional view taken along the line of A-A' of FIG. 8, FIG. 11 is a perspective view showing a state before the releasing rotation plate is rotated under the condition that the buckle according to the embodiment of the present invention is released, FIG. 12 is a perspective view showing a state where the releasing rotation plate is rotated under the condition that the buckle according to the embodiment of the present invention is released, FIG. 13 is a perspective view of a portion of a male buckle member of the buckle according to the embodiment of the present invention viewed from the bottom, FIG. 14 is a perspective view of the female buckle member of the buckle according to the embodiment of the present invention viewed from the top, FIG. 15 is a perspective view of the female buckle member of the buckle according to the embodiment of the present invention viewed from the bottom, FIG. 16 is a perspective view of the releasing rotation plate of the buckle according to the embodiment of the present invention viewed from the bottom, and FIG. 17 is a sectional view showing a releasing process of the buckle according to the embodiment of the present invention.

As shown in FIGS. 4 to 17, the buckle according to the embodiment of the present invention includes: a male buckle member 100 having a first magnet 101 buried or received in the middle part thereof; a female buckle member 200 coupled with and uncoupled from the male buckle member 100 in a sliding manner and having a second magnet 201 buried or received in the middle part thereof; locking and unlocking means respectively disposed at the male buckle member 100 and the female buckle member 200 to be locked or unlocked by a relative sliding action of the male buckle member 100 and the female buckle member 200; and releasing means respectively disposed at the male buckle member 100 and the female buckle member 200 to slide the male buckle member 100 and the female buckle member 200 in a release direction so that the locking and unlocking means are unlocked (released) and the male buckle member 100 and the female buckle member 200 are released from each other.

In detail, the male buckle member 100 includes: a male buckle plate type part 110 in which the first magnet 101 is buried or received and fixed; and a strap connection part 120 formed integrally with an end portion of the male buckle plate type part 110 so that a belt or a strap is connected.

The reference numeral 111 designates a first magnet mounting part in which the first magnet 101 is buried or received and fixed.

Furthermore, the male buckle member 100 is configured such that elements of the locking and unlocking means and elements of the releasing means, which will be described in detail later, are formed integrally with each other.

The strap connection part 120 includes a cross bar 121 to which a free end portion of the strap is caught and connected. The strap connection part 120 including the cross bar 121 may have various forms and structures and may have one of known forms and structures, and a detailed description of the strap connection part will be omitted.

The female buckle member 200 includes: a female buckle plate type part 210 having a through hole part 211 formed in one side and the second magnet 201 buried or received in the middle part of the other side to be fixed; and side wall parts 220 protruding from both sides of the female buckle plate type part 210.

The reference numeral 212 designates a second magnet mounting part in which the second magnet 201 is buried or received to be fixed.

Additionally, the female buckle member 200 is configured such that elements of the locking and unlocking means and elements of the releasing means, which will be described in detail later, are formed integrally with each other.

Next, the locking and unlocking means respectively disposed at the male buckle member 100 and the female buckle member 200 to be locked or unlocked by the relative sliding action of the male buckle member 100 and the female buckle member 200 will be described.

The locking and unlocking means include: locking and unlocking coupling parts 310 protruding from both sides of the bottom surface of the male buckle plate type part 110; and locking and unlocking coupled parts 320 formed at both sides of the bottom surface of the female buckle plate type part 120 of the female buckle member 200 so that the locking and unlocking coupling parts 310 and the locking and unlocking coupled parts 320 are coupled with each other to be locked and unlocked (released) depending on a back-and-forth sliding action of the locking and unlocking coupling parts 310.

The locking and unlocking coupling parts 310 are protrusions formed at both sides around the first magnet 101 of the male buckle plate type part 110, and the protrusions are formed in a triangular shape (right-angled triangle) when being viewed from the rear side and have locking protrusions 311 formed at the bottom ends thereof.

Here, each of the triangular protrusions 311 has an inclined plane of the right-angled triangle facing outwards.

Moreover, the locking and unlocking coupled parts 320 include: through holes 321 formed at both sides around the second magnet 201 of the female buckle plate type part 210; and retaining plates 322 horizontally protruding from the inside of the through holes 321, having upper end edges 322*a* formed to correspond to the inclined surfaces of the protrusions 311 of the locking and unlocking coupling parts 310, and being inserted into the locking and unlocking coupling parts 310 (See FIGS. 14 and 15).

Next, the releasing means which is disposed at the male buckle member 100 to slide the male buckle member 100 and the female buckle member 200 in the release direction so that the locking and unlocking means are unlocked (released) and the male buckle member 100 and the female buckle member 200 are released from each other will be described.

The releasing means includes: a pair of hinge coupling pieces 410 horizontally extending from both sides of the other end portion of the male buckle plate type part 110; a releasing rotation plate 420 of which one end portion is hinge-coupled to the hinge coupling piece 410 to be rotatably coupled to the male buckle member 100; a gripping member 430 detachably joined to the other end portion of the releasing rotation plate 420; an elastic member 440 formed on the male buckle plate type part 110 between the hinge coupling pieces 410 to elastically support the releasing rotation plate 420 in a counterrotation direction; and release linking means respectively formed on the female buckle member 200 and the releasing rotation plate 420 so that the locking and unlocking coupling parts 310 are released from the locking and unlocking coupled parts 320 by relatively moving the male buckle member 100 and the female buckle member 200 in the release direction due to the rotation of the releasing rotation plate 420.

The releasing rotation plate 420 includes: a manipulation plate part 421; a pair of plate type protrusions 422 formed at both sides of the bottom surface of the manipulation plate part 421; and hinge shafts 423 formed on the outer surfaces of the plate type protrusions 422 to be hinge-coupled to hinge holes 411 formed in the hinge coupling pieces 410 of the male buckle plate type part 110.

Figure 18:
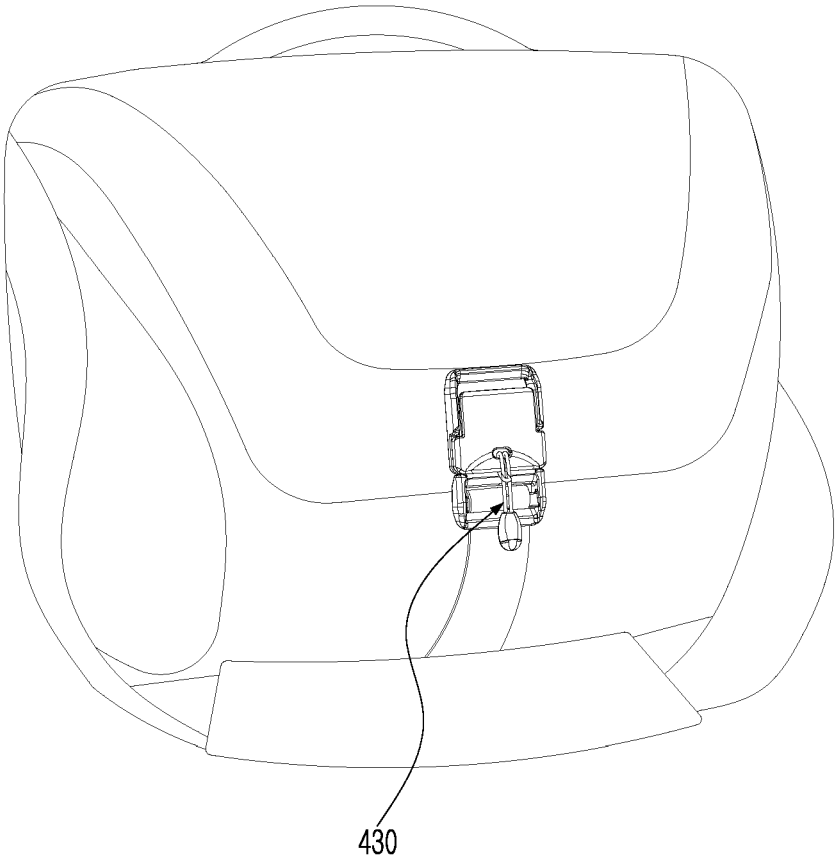
FIG. 18 is a view showing an example that the buckle according to the embodiment of the present invention is applied to a bag.
Figure 19:
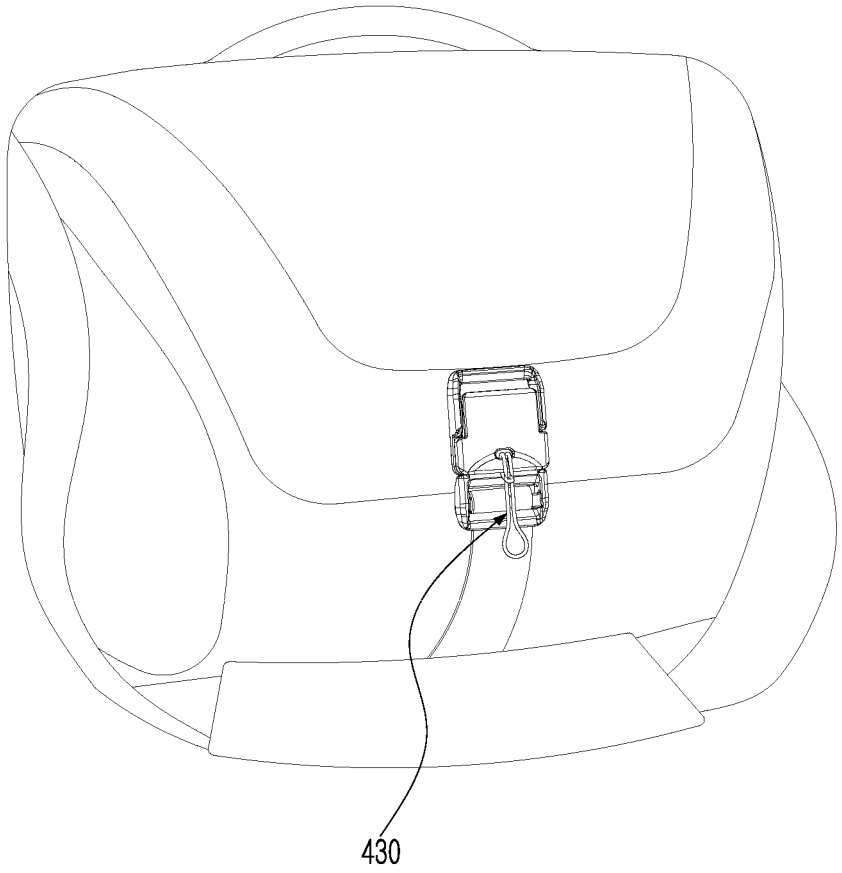
FIG. 19 is a view showing another example that the buckle according to the embodiment of the present invention is applied to a bag.

The gripping member 430 may be a strap connected to a gripping member connection hole 431 formed in the releasing rotation plate 420, or a strap having a gripper disposed at an end portion thereof (see FIG. 18), or a strip having a ring disposed at an end portion thereof (see FIG. 19).

Furthermore, the gripping member 430 may be not the strap but may be a releasing protrusion formed integrally with the upper surface of the other end portion of the releasing rotation plate 420.

The elastic member 440 may be a plate spring. In detail, the elastic member 440 may be an elastic piece extends integrally from the other end portion of the male buckle plate type part 110 of the male buckle member 100 to one side to apply elastic force upwards.

In the examples shown in the drawings, the elastic member 440 may be formed on a frame part 441 protruding integrally from the bottom surface of the other end portion of the male buckle plate type part 110 of the male buckle member 100.

Continuously, the release linking means includes: a sliding cam groove 450 formed on one side of a lower end portion of the plate type protrusion 422 of the releasing rotation plate 420; and a sliding cam protrusion 460 formed at the female buckle member 200 to correspond to the shape of the sliding cam groove 450.

The sliding cam groove 450 is formed in a rectangular shape that the lower end of the plate type protrusion 422 becomes the base line, and the side facing the direction that the male buckle member 100 and the female buckle member 200 are coupled with each other is a downwardly inclined surface 451.

In addition, the sliding cam protrusion 460 has a shape corresponding to the sliding cam groove 450, and the side facing the direction that the male buckle member 100 and the female buckle member 200 are coupled with each other is a downwardly inclined surface 461.

As shown in FIG. 17, the release linking means ordinarily keeps an unrotated state by the elastic member 440, but when the releasing rotation plate 420 is rotated, right-angled sides of the sliding cam groove 450 and the sliding cam protrusion 460 are interfered against each other and move along the two inclined surfaces 451 and 461, so that the male buckle member 100 and the female buckle member 200 to which the releasing rotation plate 420 are connected are slidably moved in a direction that the male buckle member 100 and the female buckle member 200 face each other, namely, in the release direction. Therefore, the locking and unlocking coupling parts 310 and the locking and unlocking coupled parts 320 are released (unlocked) from each other so that the male buckle member 100 and the female buckle member 200 are released from each other.

As described above, the male buckle member 100 and the female buckle member 200 can be easily released from each other just by rotation of the releasing rotation plate 420, and especially, the buckle can be rapidly unlocked in an emergency situation since being easily released just by one hand or one finger effortlessly.

FIGS. 18 and 19 are views showing examples that the buckle according to the embodiment of the present invention is applied to a bag, and the buckle according to the embodiment of the present invention may be applied to belts, various articles or devices requiring coupling.

As described above, the buckle according to an embodiment of the present invention is not easily released under an unintended situation, can firmly keep fastening force of the buckle, can be easily released just with one hand or one finger when a user releases the buckle, and can be locked and unlocked easily and rapidly in time of emergency, thereby promoting usability and safety.

While the present invention has been particularly shown and described with reference to the exemplary embodiments thereof, it will be understood by those of ordinary skill in the art that various changes and modifications may be made therein without departing from the technical idea and scope of the present invention. For instance, the described technique may be executed in a different order from the described method, or the components of the described system, structure, device or circuit may be combined or connected in a different form from the described method or may be substituted or replaced with other components or equivalents.

Additionally, it will be understood by those of ordinary skill in the art that the above embodiments of the present invention are just exemplified. Therefore, it would be understood that the embodiments disclosed in the present invention are not to limit the technical idea of the present invention but to describe the present invention. It should be also understood that the protective scope of the present invention is interpreted by the following claims and all technical ideas within the equivalent scope belong to the technical scope of the present invention.

What is claimed is:

1. A buckle comprising:

a male buckle member having a first magnet buried or received in the middle part thereof;

a female buckle member coupled with and uncoupled from the male buckle member in a sliding manner and having a second magnet buried or received in the middle part thereof;

locking and unlocking means respectively disposed at the male buckle member and the female buckle member to be locked or unlocked by a relative sliding action of the male buckle member and the female buckle member; and releasing means respectively disposed at the male buckle member and the female buckle member to slide the male buckle member and the female buckle member in a release direction so that the locking and unlocking means are unlocked, wherein the male buckle member comprises:

a male buckle plate type part having a first magnet mounting part in which the first magnet is buried or received to be fixed; and a strap connection part formed at an end portion of the male buckle plate type part so that a belt or a strap is connected, wherein the female buckle member comprises: a female buckle plate type part having a through hole part formed in one side and a second magnet mounting part formed at the other side so that the second magnet is buried or received to be fixed therein; and side wall parts protruding from both sides of the female buckle plate type part, and wherein the locking and unlocking means respectively comprise: locking and unlocking coupling parts protruding from both sides of the bottom surface of the male buckle plate type part; and locking and unlocking coupled parts formed at both sides of the bottom surface of the female buckle plate type part so that the locking and unlocking coupling parts and the locking and unlocking coupled parts are coupled with each other to be locked and unlocked depending on a relative back-and-forth sliding action thereof, wherein the locking and unlocking coupling parts are protrusions formed at both sides of the male buckle plate type part, and the protrusions are formed in a right-angled triangle of which the inclined plane faces the outside when being viewed from the rear side and have locking protrusions formed at the bottom ends thereof, and wherein the locking and unlocking coupled parts comprise: through holes formed at both sides of the female buckle plate type part; and retaining plates horizontally protruding from the inside of the through holes, having upper end edges formed to correspond to the inclined surfaces of the locking protrusions of the locking and unlocking coupling parts, and being inserted into the locking and unlocking coupling parts.

2. An article having the buckle according to claim 1.

3. A buckle comprising:

a male buckle member having a first magnet buried or received in the middle part thereof;

a female buckle member coupled with and uncoupled from the male buckle member in a sliding manner and having a second magnet buried or received in the middle part thereof;

locking and unlocking means respectively disposed at the male buckle member and the female buckle member to be locked or unlocked by a relative sliding action of the male buckle member and the female buckle member; and releasing means respectively disposed at the male buckle member and the female buckle member to slide the male buckle member and the female buckle member in a release direction so that the locking and unlocking means are unlocked, wherein the male buckle member comprises:

a male buckle plate type part having a first magnet mounting part in which the first magnet is buried or received to be fixed; and a strap connection part formed at an end portion of the male buckle plate type part so that a belt or a strap is connected, wherein the female buckle member comprises: a female buckle plate type part having a through hole part formed in one side and a second magnet mounting part formed at the other side so that the second magnet is buried or received to be fixed therein; and side wall parts protruding from both sides of the female buckle plate type part, and wherein the locking and unlocking means respectively comprise: locking and unlocking coupling parts protruding from both sides of the bottom surface of the male buckle plate type part; and locking and unlocking coupled parts formed at both sides of the bottom surface of the female buckle plate type part so that the locking and unlocking coupling parts and the locking and unlocking coupled parts are coupled with each other to be locked and unlocked depending on a relative back-and-forth sliding action thereof, wherein the releasing means comprises:

a pair of hinge coupling pieces extending from both sides of the other end portion of the male buckle plate type part;

a releasing rotation plate of which one end portion is hinge-coupled to the hinge coupling piece to be rotatably coupled to the male buckle member;

a gripping member detachably joined to the other end portion of the releasing rotation plate;

an elastic member formed on the male buckle plate type part between the hinge coupling pieces to elastically support the releasing rotation plate in a counterrotation direction; and release linking means respectively formed on the female buckle member and the releasing rotation plate so that the locking and unlocking coupling parts are released from the locking and unlocking coupled parts by relatively moving the male buckle member and the female buckle member in the release direction due to the rotation of the releasing rotation plate.

4. The buckle according to claim 3, wherein the releasing rotation plate comprises: a manipulation plate part; a pair of plate type protrusions formed at both sides of the bottom surface of the manipulation plate part; and hinge shafts formed on the outer surfaces of the plate type protrusions to be hinge-coupled to the hinge coupling pieces.

5. The buckle according to claim 4, wherein the release linking means comprises:

a sliding cam groove formed on one side of a lower end portion of the plate type protrusion of the releasing rotation plate; and a sliding cam protrusion formed at the female buckle member to correspond to the shape of the sliding cam groove.

6. The buckle according to claim 5, wherein the sliding cam groove is formed in a rectangular shape that the lower end of the plate type protrusion becomes the base line, and the side facing the direction that the male buckle member and the female buckle member are coupled with each other is a downwardly inclined surface, and wherein the sliding cam protrusion has a shape corresponding to the sliding cam groove.

7. The buckle according to claim 3, wherein the gripping member is a strap connected to a connection hole formed in the releasing rotation plate, or a strap having a gripper disposed at an end portion thereof.

8. The buckle according to claim 3, wherein the gripping member is a strap connected to a connection hole formed in the releasing rotation plate and has a ring disposed at an end portion thereof.

9. An article having the buckle according to claim 3.

* * * * *